US009022220B2

(12) United States Patent
Ozeki et al.

(10) Patent No.: US 9,022,220 B2
(45) Date of Patent: May 5, 2015

(54) SIEVING SYSTEM, AND METHODS OF NOTIFYING INFORMATION, DRIVING AND FEEDING

(71) Applicants: Kaori Ozeki, Shizuoka (JP); Tatsushi Umayahara, Shizuoka (JP); Hideo Ichikawa, Shizuoka (JP); Tetsuya Yoshida, Shizuoka (JP)

(72) Inventors: Kaori Ozeki, Shizuoka (JP); Tatsushi Umayahara, Shizuoka (JP); Hideo Ichikawa, Shizuoka (JP); Tetsuya Yoshida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 107 days.

(21) Appl. No.: 13/889,556

(22) Filed: May 8, 2013

(65) Prior Publication Data

US 2013/0319913 A1 Dec. 5, 2013

(30) Foreign Application Priority Data

May 31, 2012 (JP) ..... 2012-124588

(51) Int. Cl.

| | |
|---|---|
| ***B07B 1/42*** | (2006.01) |
| ***B07B 1/00*** | (2006.01) |
| ***B07B 1/06*** | (2006.01) |
| ***B07B 13/16*** | (2006.01) |
| ***B07B 13/18*** | (2006.01) |

(52) U.S. Cl.

CPC ... *B07B 1/00* (2013.01); *B07B 1/42* (2013.01); *B07B 1/06* (2013.01); *B07B 13/16* (2013.01); *B07B 13/18* (2013.01)

(58) Field of Classification Search

CPC ..... B07B 1/42; B07B 1/20; B07B 1/00; B07B 1/06; B07B 13/16; B07B 1/44; B07B 1/528

USPC ..... 209/306, 233

See application file for complete search history.

(56) References Cited

U.S. PATENT DOCUMENTS

| | | | | |
|---|---|---|---|---|
| 3,964,996 | A * | 6/1976 | Holz et al. | 209/17 |
| 2012/0234735 | A1 | 9/2012 | Ichikawa et al. | |

FOREIGN PATENT DOCUMENTS

| | | | |
|---|---|---|---|
| CN | 86100513 | A | 9/1987 |
| CN | 2520950 | Y | 11/2002 |
| CN | 201200974 | Y | 3/2009 |
| CN | 201454862 | U | 5/2010 |
| JP | 61-204070 | | 9/1986 |
| JP | 8-257502 | | 10/1996 |
| JP | 2006-023782 | | 1/2006 |
| JP | 2007-079444 | | 3/2007 |
| JP | 2010-122313 | A | 6/2010 |
| JP | 2012-206111 | | 10/2012 |
| WO | WO 2013027402 | A1 * | 2/2013 |

OTHER PUBLICATIONS

Combined Chinese Office Action Search Report issued on Dec. 24, 2014 in Patent Application No. 201310211343.8 with English translation of category of cited documents.

* cited by examiner

*Primary Examiner* — Jeremy R Severson

(74) *Attorney, Agent, or Firm* — Oblon, McClelland, Maier & Neustadt, L.L.P.

(57) ABSTRACT

A sieving system includes a filter; a blade stirring a powder accumulated on the filter; a driver driving the blade; a notifier notifying predetermined information of a status of the filter, based on a load of the driver while driving the blade.

11 Claims, 11 Drawing Sheets

SIEVING SYSTEM, AND METHODS OF NOTIFYING INFORMATION, DRIVING AND FEEDING

CROSS-REFERENCE TO RELATED APPLICATIONS

This patent application is based on and claims priority pursuant to 35 U.S.C. §119 to Japanese Patent Application No. 2012-124588, filed on May 31, 2012, in the Japan Patent Office, the entire disclosure of which is hereby incorporated by reference herein.

BACKGROUND OF THE INVENTION

1. Field of the Invention

The present invention relates to a method of detecting phenomena generated during operation of a sieving apparatus and a method of executing control of the phenomena.

2. Description of the Related Art

Conventionally, in order to remove coarse particles mixed in a powder, the powder is sieved with a filter. As for a toner as one of examples of the powder, coarse particles are removed with a filter before the toner is used for image formation.

Japanese published unexamined application No. JP-2006-023782-A discloses a sieving apparatus oscillating a filter to sieve a toner to remove coarse particles therefrom. However, a frictional heat generated by oscillation of the filter softens a toner to clog the filter.

In order to detect clogging of the filter when sieving, Japanese published unexamined application No. JP-S61-204070-A discloses a method of measuring a flow amount of a powder fed to the filter and a flow amount thereof discharged from the filter by at least two flow meters. A ratio of the flow amount of a powder fed and the flow amount thereof discharged is compared with a predetermined normal ratio to detect abnormality and transmit an abnormal signal. However, the flow meters enlarge the apparatus.

Because of these reasons, a need exist for a sieving system capable of notifying status of a filter such as clogging without a flow meter which enlarges the system.

SUMMARY OF THE INVENTION

Accordingly, one object of the present invention to provide a sieving system capable of notifying status of a filter such as clogging without a flow meter which enlarges the system.

Another object of the present invention to provide a method of notifying information in the system.

A further object of the present invention to provide a method of controlling driving in the system.

Another object of the present invention to provide method of controlling feeding in the system.

These objects and other objects of the present invention, either individually or collectively, have been satisfied by the discovery of a sieving system, comprising:

a filter;

a blade configured to stir a powder accumulated on the filter;

a driver configured to drive the blade;

a notifier configured to notify predetermined information of a status of the filter, based on a load of the driver while driving the blade.

In another aspect, the present invention provides a sieving system, comprising:

a filter;

a blade configured to stir a powder accumulated on the filter;

a driver configured to drive the blade; and a drive controller configured to control the driver driving the blade, based on a load of the driver while driving the blade.

In a further aspect, the present invention provides a sieving system, comprising:

a filter;

a feeder configured to feed a powder on the filter;

a blade configured to stir the powder accumulated on the filter;

a driver configured to drive the blade; and a feed controller configured to control the feeder feeding powder on the filter, based on a load of the driver while driving the blade.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
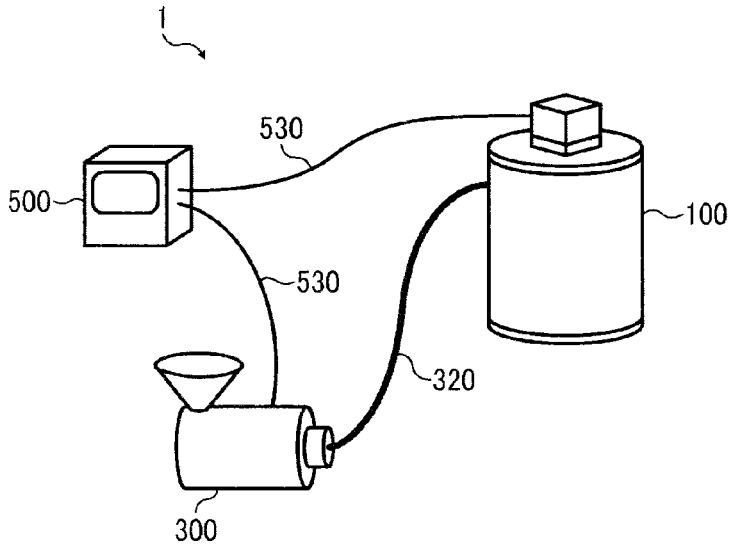
FIG. 1 is a schematic view illustrating an embodiment of the sieving system of the present invention.
Figure 2:
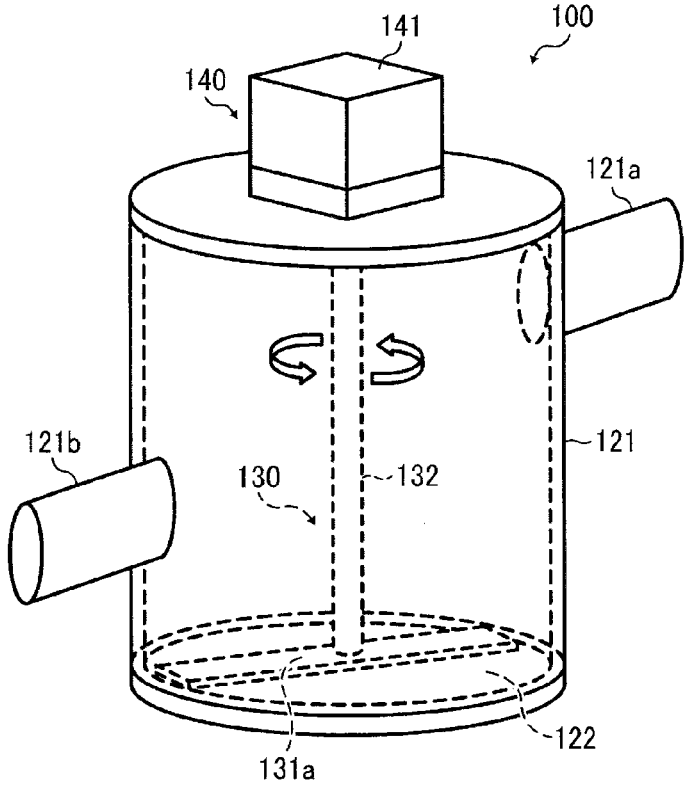
FIG. 2 is a perspective view illustrating a sieving apparatus.
Figure 3:
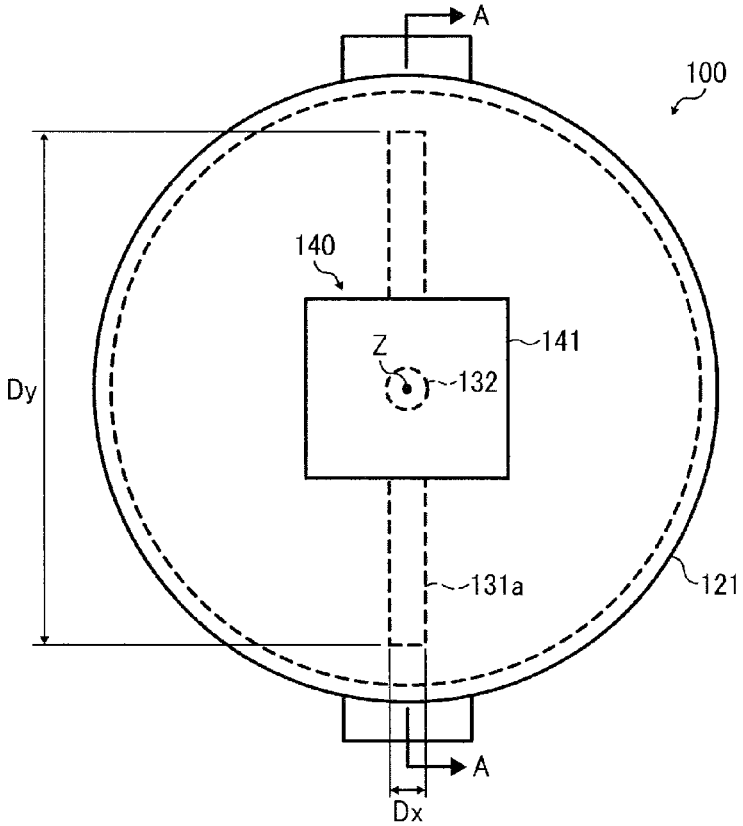
FIG. 3 is a plain view of the sieving system in FIG. 2.

The present invention provides a sieving system capable of notifying status of a filter such as clogging without a flow meter which enlarges the system.

More particularly, the present invention relates to a sieving system, comprising:

a filter;

a blade configured to stir a powder accumulated on the filter;

a driver configured to drive the blade;

a notifier configured to notify predetermined information of a status of the filter, based on a load of the driver while driving the blade.

In another aspect, the present invention relates to a sieving system, comprising:

a filter;

a blade configured to stir a powder accumulated on the filter;

a driver configured to drive the blade; and a drive controller configured to control the driver driving the blade, based on a load of the driver while driving the blade.

In a further aspect, the present invention relates to a sieving system, comprising:

a filter;

a feeder configured to feed a powder on the filter;

a blade configured to stir the powder accumulated on the filter;

a driver configured to drive the blade; and a feed controller configured to control the feeder feeding powder on the filter, based on a load of the driver while driving the blade.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a schematic view illustrating an embodiment of the sieving system of the present invention. As FIG. 1 shows, a sieving system 1 of this embodiment includes a sieving apparatus 100 sieving a powder to remove coarse particles therefrom, a powder feeder 300 as an embodiment of feeding a powder to the sieving apparatus 100 and a controller 500. In this embodiment, the controller 500 and the sieving apparatus 100, and the controller 500 and the powder feeder 300 are connected to each other with an outer bus 530 used for transmitting information such as signals and data, or feeding electric power. The powder feeder 300 and the sieving apparatus 100 are connected to each other with a hose 320. The hose 32 is used for transferring a powder fed from the powder feeder 300 to the sieving apparatus 100.

The powder feeder 300 is not particularly limited, provided it can feed a powder, e.g., known apparatuses such as a powder transport pump, an air transporter and a hopper. In addition, the powder feeder 300 includes a switch starting and finishing feeding a powder, and a converter converting a speed of feeding a powder, based on signals transmitted from the controller 500. The powder feeder 300 may intermittently or continuously feed a powder to the sieving apparatus 100. A continuous operation can be performed when the powder feeder 300 feeds a powder to the sieving apparatus 100.

Next, the sieving apparatus 100 is explained, referring to FIGS. 2 to 11.

The sieving apparatus 100 includes a frame 121 as an embodiment of a cylindrical body and a filter 122 at the bottom of the frame 121, a rotor 130, a driver 140 and other means and members when necessary. The sieving apparatus 100 works as a container containing a powder fed in the frame 121. In addition, the sieving apparatus 100 sieves a powder fed in the frame 121 to remove coarse particles therefrom. It is preferable that the sieving apparatus 100 is vertically set, but may be set at a tilt.

The frame 121 is not limited in its shape, provided a powder fed therein is guided to accumulate on the filter, and can have shapes such as a cylinder, a truncated cone, a square tube, a truncated pyramid and a hopper. The frame 121 is not particularly limited in size. The frame 121 is formed of metals such as stainless steel, aluminum and iron; resins such as ABS, FRP, polyester resins and polypropylene resins. The frame 121 may be formed of a single member or plural members. An end of the frame 121 at an opposite side of the filter 122 may be opened or closed to prevent a powder from scattering.

A feed part 121*a* connected to the hose 320 to feed a powder on the filter 122 is located at least a part on a side surface, an end surface or an upper surface of the frame 121. The size, shape and structure of the feed part 121*a* are not particularly limited, provided a powder can be fed in the sieving apparatus 100, and are selected according to the size, shape and structure of the frame 121. Specific examples of the structure of the feed part 121*a* include a tube. Specific examples of materials of the feed part 121*a* include metals such as stainless steel, aluminum and iron; resins such as ABS, FRP, polyester resins and polypropylene resins.

A discharger part 121*b* discharging a powder out of the frame 121 as an embodiment of a regulator regulating a height of a powder accumulated on the filter 122 is located on a side surface of the frame 121. When an amount of a powder fed from the feed part 121*a* is larger than that of a powder passing the filter 122, an amount of a powder accumulating thereon continues to increase. In this embodiment, since the discharger part 121*b* discharges an excessive powder out, the sieving apparatus 100 can continuously operate for a long time and a large amount of a powder can efficiently be sieved. Further, since the rotor 130 rotates while a powder accumulates at a constant height, a load to drive a blade 131 by a blade-driving motor 141 is stable and clogging is precisely detected.

The discharger part 121*b* is not particularly limited in size, shape, structure and material, provided an amount of a powder accumulated in the frame 121 is regulated, and can be selected according to the size, shape and structure of the frame 121. Specific examples of materials of the discharger part 121*b* include metals such as stainless steel, aluminum and iron; resins such as ABS, FRP, polyester resins and polypropylene resins. The discharger part 121*b* is preferably located on a side surface, an end surface or an upper surface of the frame 121 higher than an upper end of the blade 131 and lower than a lower end of the feed part 121*a*. A powder discharged from the discharger part 121*b* may be provided from the feed part 121*a*.

The filter 122 is not particularly limited, provided it can sieve a powder fed to the sieving apparatus 100 to remove coarse particles therefrom. Applicable embodiments of the filter 122 include meshes such as orthogonal meshes, oblique meshes, meander meshes and testudinal meshes; an embodiment forming a gap in a three dimension such as unwoven fabrics; and an embodiment coarse particles are substantially unable to pass through such as porous materials and hollow threads. Among these, meshes are preferably used in terms of good sieving efficiency.

The outer shape of the filter 122 is not particularly limited, e.g., a circle, an ellipse, a triangle, a quadrangle, a pentagon, a hexagon, an octagon, etc. can be used. Among these, the circle is preferably used in terms of good sieving efficiency. Filters 122 having different openings may be located in series in multistep sieving.

The opening can be selected according to the particle diameter of a powder, and preferably not less than 10 μm, more preferably not less than 15 μm, and furthermore preferably not less than 20 μm. When too small, process capacity per time is likely to deteriorate and it is difficult to efficiently obtain a powder having a desired particle diameter. In addition, clogging tends to occur.

Materials for the filter 122 are not particularly limited, e.g., metals such as stainless steel, aluminum and iron; resins such as polyamide resins (nylon), polyester resins, polypropylene resins and acrylic resins; and natural fibers such as cotton can be used. Among these, stainless steel and polyester resins are preferably used in terms of durability.

When a resin filter is used in a conventional ultrasonic sieve, oscillation of the filter could not efficiently transmit to a powder due to its elasticity. In addition, a conventional cylindrical sieve made of a resin is short of durability because of feeding a powder from an inside to an outside of the sieve by a centrifugal force. The sieving apparatus 100 of this embodiment rotates the blade 131 to sieve a powder without oscillating the filter 122. Therefore, a resin is preferably used as well for the filter 122 of the sieving apparatus 100 of this embodiment. The filter 122 formed of a resin having the same polarity as that of a powder prevents the powder from adhering thereto, and a long-time operation can be made.

The filter 122 is preferably supported by a frame, etc. to be free from wrinkles and loosening. The wrinkles and loosening not only cause a damage of the filter 122, but also uniform sieving is difficult to perform.

In this embodiment, the rotor 130 includes the blade 131 rotatable around a rotational axis X intersecting with the filter 122 close thereto and a shaft 132 the blade 131 is attachable to. When an inside of the frame 121 of the sieving apparatus 100 of this embodiment is seen form above, the blade is rotatable around the shaft 132 close to the filter 122 in the direction or the reverse direction of an arrow E. Thus, the blade 131 stirs and fluidizes a powder fed in the frame 121.

In this embodiment, the rotor 130 is not particularly limited, provided it is capable of rotating the blade 131 around the rotational axis Z close to the filter 122. For example, the blade 131 may be rotated by magnetic force without using the shaft 132. In addition, the blade 131 may be rotated by a combination of the shaft 132 and a hub. An angle formed between the rotational axis Z and the filter 122 intersecting with each other is not particularly limited, but the angle is preferably 90° because the filter 122 and the blade 131 can keep a constant distance therebetween to prevent them from contacting each other.

In this embodiment, the blade 131 is close to the filter 122 such that a vortex generated by rotation of the blade 131 reaches the filter 122. The vortex is a flow of a fluid alternately and randomly generated behind a solid when moved in the fluid. "Close" does not include a status where the blade 131 contacts the filter 122 on all of rotational orbit. A distance between two points on an opposite surface of the blade 131 and the filter 122 parallel to the rotational axis Z (D1 in FIG. 4) is preferably from 0 to 5 mm, more preferably from 0.3 to 5 mm, and furthermore preferably from 0.5 to 2 mm. When a position and a measurement point on the rotational orbit of the blade 131 vary a distance between the two points parallel to the rotational axis Z, the distance D1 is the shortest distance between two points among all the measurement points at all the positions on the rotational orbit of the blade 131. When a distance between the blade 131 and the filter 122 is longer than 5 mm, the rotation if the blade 131 occasionally does not remove coarse particles accumulated on the surface of filter 122. In addition, a powder accumulated on the filter 122 is not fully fluidized in some cases. When the blade 131 rotates contacting the filter 122, it is limited that a powder below the blade 131 moves upward from being accumulated on the filter 122, and the powder is not fully fluidized in some cases.

In this embodiment, it is not particularly limited, but the blade 131 preferably has an end close to the frame 121. A distance between the end of the blade 131 and the frame 121 (D2 in FIG. 4) is preferably not longer than 10 mm, and more preferably from 1 to 5 mm. When a position and a measurement point on the rotational orbit of the blade 131 vary a distance between the end of the blade 131 and the frame 121, the distance D2 is the shortest distance between two points among all the measurement points at all the positions on the rotational orbit of the blade 131. When the distance between the end of the blade 131 and the frame 121 is longer than 10 mm, a powder flows to the frame 121 by a centrifugal force by the rotation of the blade 131 and is occasionally difficult to discharge from the frame 121 because a vortex flow only affects a circumference of the blade 131.

The blade 131 is not particularly limited in materials, structures, sizes and shapes, and are selected according to the size, shape and structure of the frame 121. Specific examples of the materials thereof include metals such as stainless steel, aluminum and iron; and resins such as ABS, FRP, polyester resins and polypropylene resins. Among these, metals are preferably used in terms of strength. The resin preferably includes an antistat in terms of explosion proof because of handling a powder. The blade 131 may be formed of a single material or plural materials.

The shapes of the blade 131 are not particularly limited, e.g., a flat plate, a bar, a prism, a pyramid, a cylinder, a circular cone, a blade, etc. can be used. When the blade 131 is formed in the sieving apparatus 100, the blade 131 preferably has a length parallel to the rotational axis Z (a thickness Dz of the blade 131 in FIG. 4) short (thin) in a range of assuring strength. The thickness Dz of the blade 131 is specified on a distance between two points parallel to the rotational axis Z of an opposite surface of the blade 131. When a measurement point varies the distance between two points parallel to the rotational axis Z, the thickness Dz of the blade 131 is the shortest distance between two points among all the measurement points. The thickness Dz of the blade 131 is preferably from 0.5 to 10.0 mm, more preferably from 0.5 to 5.0 mm, and furthermore preferably from 0.5 to 3.0 mm. When larger than 5.0 mm, vortex generated behind the blade 131 decreases and a powder accumulated on the surface of the filter 122 is not fully fluidized, resulting in deterioration of cleanability. Further, when larger than 5.0 mm, an energy applied to a powder in a circumferential direction becomes large, which occasionally hinders moving of the powder to the filter 122. In addition, a load to a driver 140 of the rotor 130 becomes large and more energy is occasionally needed.

In order to keep strength of the blade 131, the thickness Dz of the blade 131 is preferably smaller than a length thereof (Dx in FIG. 3) when rotating around the rotational axis Z. The length of the blade 131 Dx on a distance between two points of an opposite surface of the blade 131 in a rotational direction. When a measurement point varies the distance between two points in the rotational direction, the length Dx of the blade 131 is the shortest distance between two points among all the measurement points. When thickness Dz of the blade 131 is larger than the length Dx thereof, the strength thereof occasionally deteriorates due to resistance of a toner when the blade 131 rotates. In addition, the blade 131 gives a speed to a toner too much in the rotational direction, and occasionally prevents the toner from passing the filter 121.

The blade 131 is not particularly limited in cross-sectional shapes. In this embodiment, the cross-sectional shapes may be unsymmetrical as shown in FIGS. 6A to 6G and 7A to 7G, and symmetrical as shown in FIGS. 6H to 6J and 7H to 7J. Any one of them is preferably used. A C-C cross-section and a D-D cross-section of the blade 131 may be the same.

Figure 8:
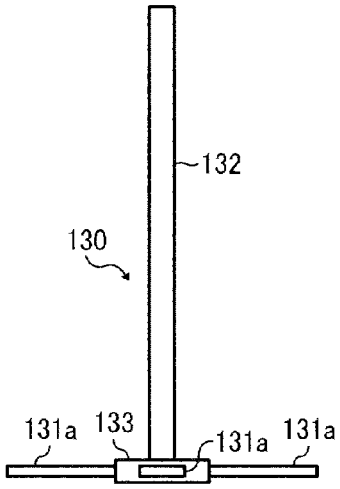
FIG. 8 is an elevational view illustrating a rotor having three blades.
Figure 9:
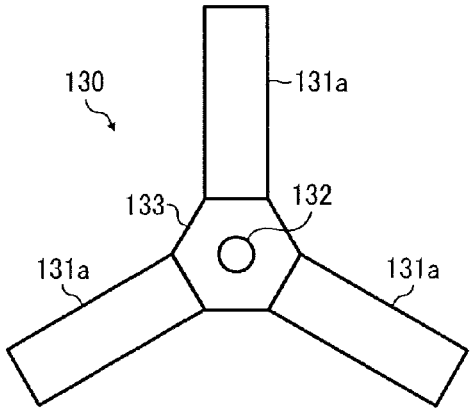
FIG. 9 is a plain view illustrating the rotor in FIG. 8.
Figure 10:
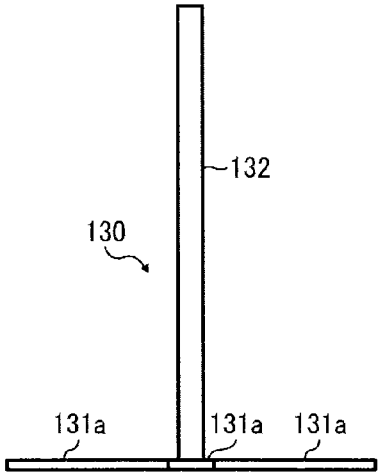
FIG. 10 is an elevational view illustrating a rotor having four blades.
Figure 11:
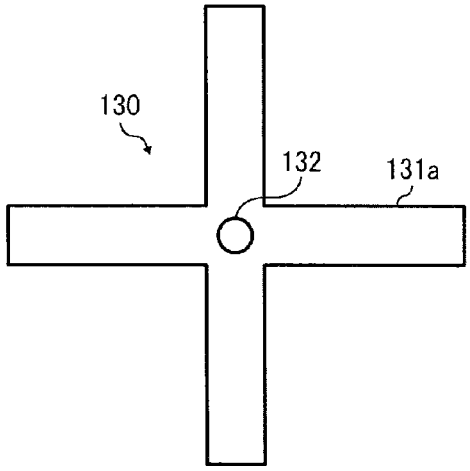
FIG. 11 is a plain view illustrating the rotor in FIG. 10.

The number of the blade 131 located on the same plane is not particularly limited, and may be two (FIGS. 2 to 5), three (FIGS. 8 and 9) or four (FIGS. 10 and 11). The rotor 130 in FIGS. 8 and 9 is an embodiment in which each of the blade 131 and the shaft 132 are fixed by the hub 133. The number of the blade 131 is preferably from 1 to 8, more preferably from 1 to 4, and furthermore preferably 2. When more than 8, the blade 131 possibly blocks a powder from falling from the filter 122, resulting in deterioration of maintainability.

Figure 5:
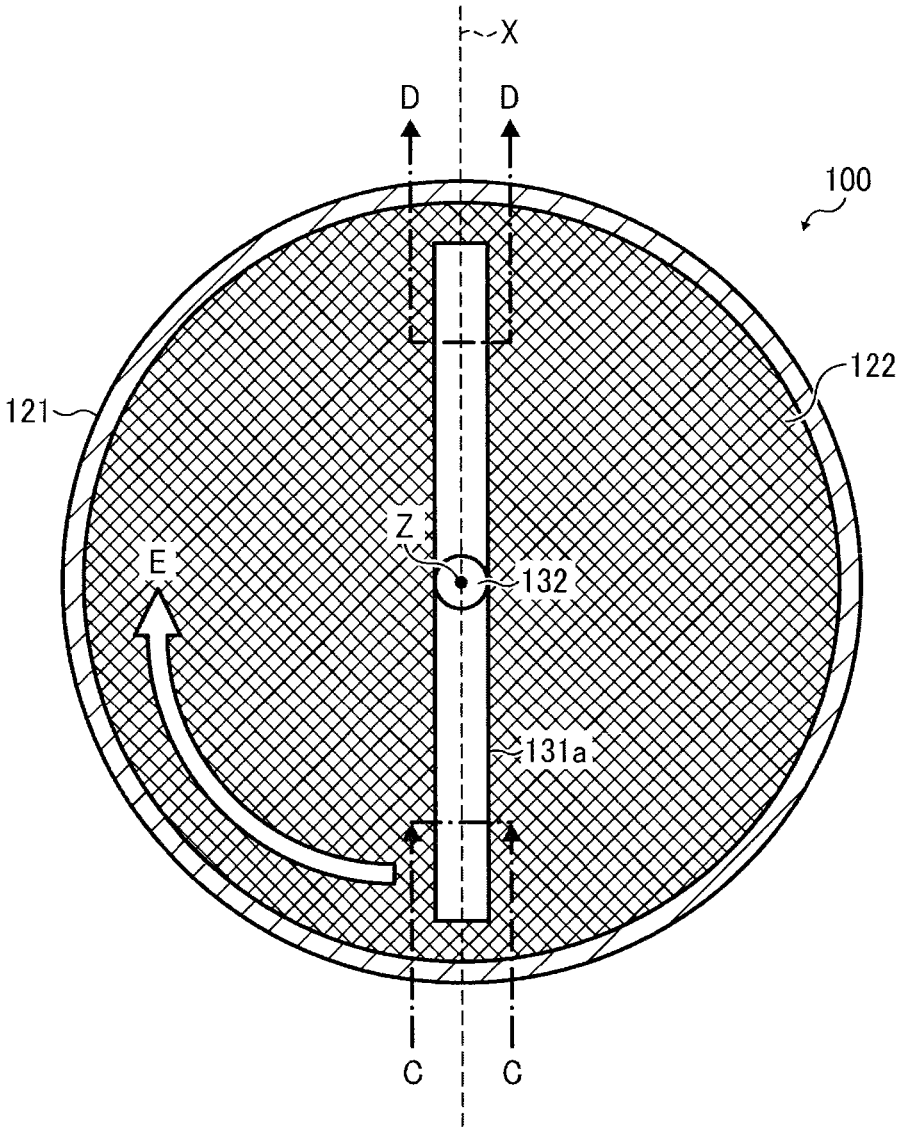
FIG. 5 is a top view illustrating a B-B cross-section of the sieving system in FIG. 4.
Figure 6A:
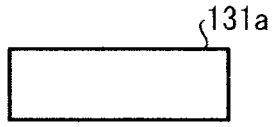
FIGS. 6A to 6J are cross-sectional views illustrating embodiments of a C-C cross-section of the blade in the sieving system in FIG. 5.
Figure 6B:
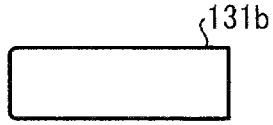
Figure 6C:
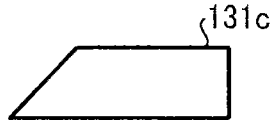
Figure 6D:
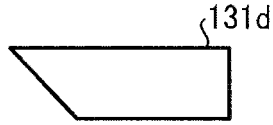
Figure 6E:
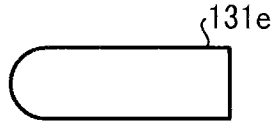
Figure 6F:
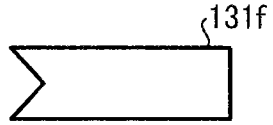
Figure 6G:
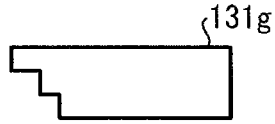
Figure 6H:
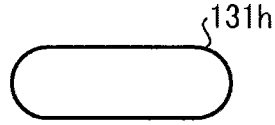
Figure 6I:
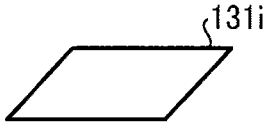
Figure 6J:
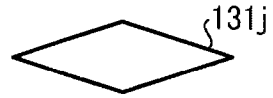
Figure 7A:
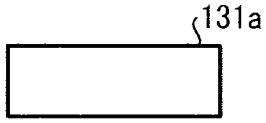
FIGS. 7A to 7J are cross-sectional views illustrating embodiments of a D-D cross-section of the blade in the sieving system in FIG. 5.
Figure 7B:
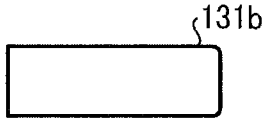
Figure 7C:
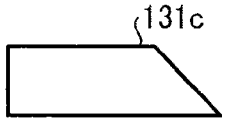
Figure 7D:
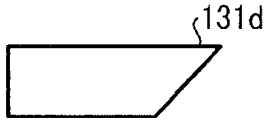
Figure 7E:
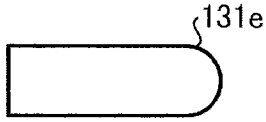
Figure 7F:
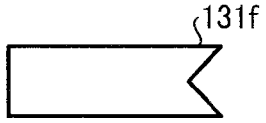
Figure 7G:
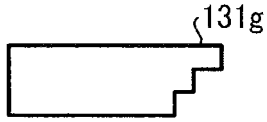
Figure 7H:
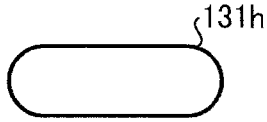
Figure 7I:
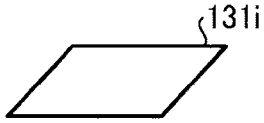
Figure 7J:
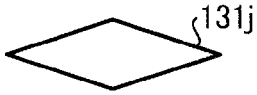

An angle of the blade 131 relative to the filter 122 in an X-axis direction in FIG. 5 is not particularly limited, and the blade 131 preferably has an angle of from 3 to 10°, more preferably from 0 to 10°, and furthermore preferably 0° (horizontal) relative to the filter 122. When larger than 10°, vortex generated behind the blade 131 decreases, resulting in deterioration of cleanability. In addition, an energy applied to a powder in a circumferential direction becomes large, which occasionally hinders moving of the powder to the filter 122. Further, a load to a driver 140 of the rotor 130 occasionally becomes large.

A ratio [(X/Y)×100] of an orbital area X made by rotation of the blade 131 and an area Y of the filter 122 is preferably from 60 to 150%, and more preferably from 80 to 100%. When less than 60%, an energy by rotation of the blade 131 may not spread over the whole surface of the filter 122. In addition, a centrifugal force by rotation of the blade 131 gathers a powder to the frame 121 and the blade 131 is occasionally unable to give an energy to the powder. When greater than 150%, a centrifugal force by rotation of the blade 131 moves a powder to an outside of the filter 122, and the powder thereon decreases, resulting in inability of sieving.

A rotational (circumferential) speed of the blade 131 is not particularly limited, but preferably from 3 m/s to 30 m/s. When less than 3 m/s, an energy given to a powder of the blade 131 decreases, resulting in insufficient cleanability and fluidization of the powder. When greater than 30 m/s, a powder receives so much energy that increases in circumferential speed, which possibly blocks the powder from falling to the surface of the filter 122. When a powder is excessively fluidized, an amount thereof passing the filter 122 occasionally decreases.

The shaft 132 is formed on the rotational axis Z in the frame 121, and an end thereof is fixed on the diver 140 and the other end thereof is fixed on the blade 131. The drive 140 drives to rotate the blade 131 and the shaft 132 around the rotational axis Z.

The shaft 132 is not particularly limited in materials, structures, sizes and shapes, and are selected according to the size, shape and structure of the frame 121. Specific examples of the materials thereof include metals such as stainless steel, aluminum and iron; and resins such as ABS, FRP, polyester resins and polypropylene resins. The shaft 132 may be formed of a single material or plural materials. The shapes of the shaft 132 include a bar, a prism, etc.

In this embodiment, the driver 140 includes a blade-driving motor 141, a bearing 142 and an encoder 143. The blade-driving motor 141 is an embodiment of drive means, and rotates the rotor 130 including the blade 131 around the rotational axis Z. The blade-driving motor 141 is controlled by control means such as PLCs (programmable logic controller) and computers. The bearing 142 supports the shaft 132 to precisely rotate the rotor 130. The bearing 142 is located at an outside of the frame 121 to avoid malfunction due to immigration of a powder. When there is a possibility that a powder enters the driver 140 passing through a gap between the shaft 132 and the frame 121, a mechanism preventing the powder from entering the driver 140 can be formed. Such a mechanism includes an air seal blowing air in the gap between the bearing 142 and the frame 121 to blow air out from a gap between the shaft 132 and the frame 121 to prevent a powder from entering the driver 140, and an air outlet to prevent a powder from entering the driver 140.

The encoder 143 generates a pulse waveform according to a rotational speed of the blade-driving motor 141 and outputs the pulse waveform as a rotational output signal. The blade-driving motor 141 controls a rotational speed of the blade 131 by feeding the signal back.

The driver 140 may include a known brake mechanism stopping rotation of the rotor 130 when the apparatus is stopped. When the brake mechanism stops rotation of the blade 131 when the apparatus is stopped, fluidization of a toner instantly stops and the toner is precisely fed to an image developer 180 by the sieving apparatus 100.

Figure 12:
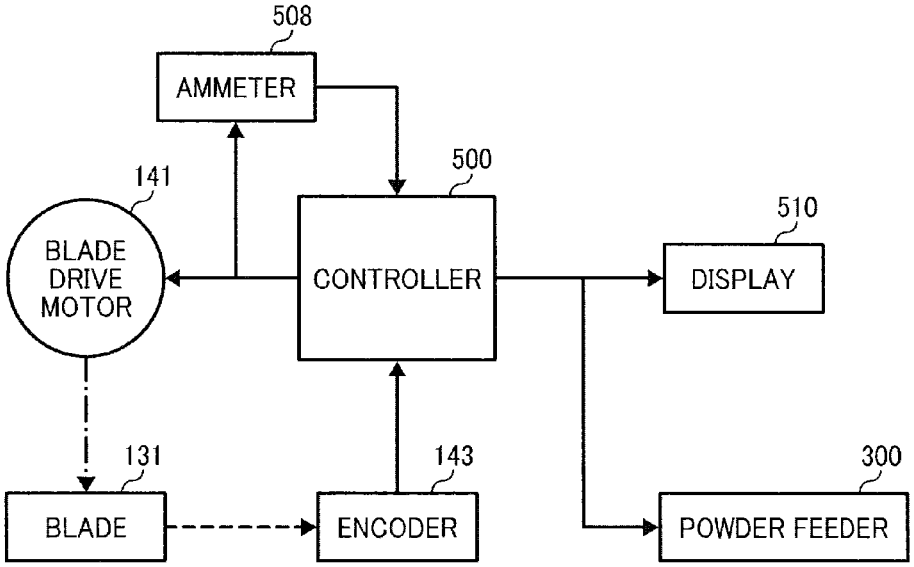
FIG. 12 is a block diagram of the sieving system.
Figure 13:
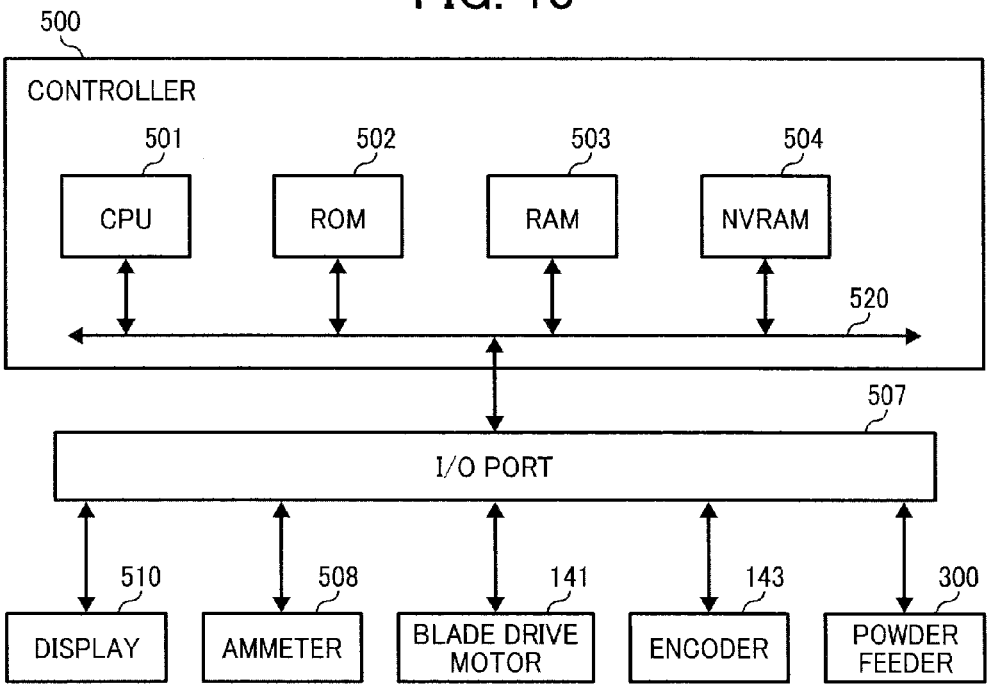
FIG. 13 is a hardware configuration diagram of a controller.
Figure 14:
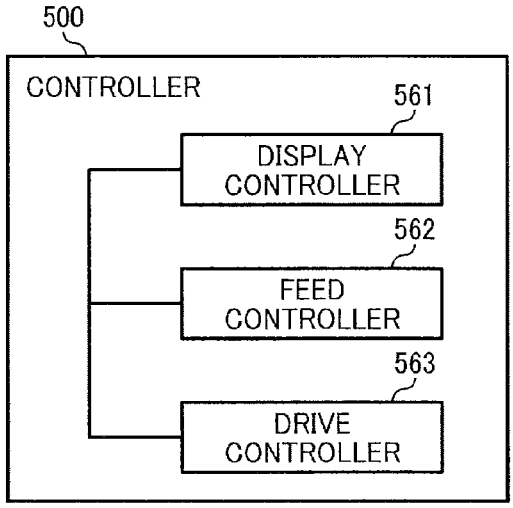
FIG. 14 is a functional block diagram of the controller.
Figure 15:
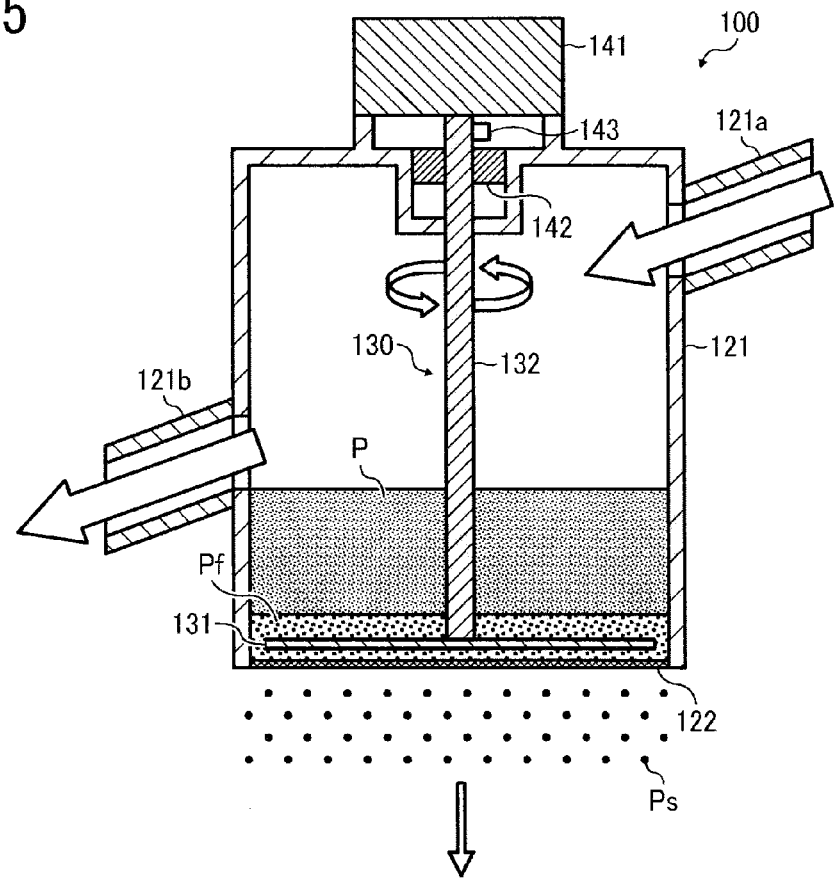
FIG. 15 is a schematic view illustrating a status of sieving a powder by the sieving apparatus in FIG. 2.

Next, the controller 500 in the sieving system 1 is explained, referring to FIGS. 12 to 14. FIG. 12 is a block diagram of the sieving system. FIG. 13 is a hardware configuration diagram of a controller. FIG. 14 is a functional block diagram of the controller.

As shown in FIG. 12, the controller 500 provides an electric power having a predetermined current value to the blade-driving motor 141. Then, the blade-driving motor 141 is activated to rotate the blade 131. The encoder 143 generates a pulse waveform according to a rotational speed of the blade 131 and outputs the pulse waveform to the controller 500 as a rotational output signal. The controller 500 calculates a rotational speed of the blade 131, based on the rotational output signal, and decreases the current value when the rotational speed is higher than a predetermined value and provides an electric power to the blade-driving motor 141. The controller 500 increases the current value when the rotational speed is lower than a predetermined value and provides an electric power to the blade-driving motor 141. Such a feedback control rotates the blade 131 at a predetermined speed.

An ammeter 508 calculates a current value provided to the blade-driving motor 141 and outputs the current value to the controller 500. When the blade 131 is subjected to a feedback control to rotate at a predetermined rotational speed, a current value provided to the blade-driving motor 141 varies, based on a load which is an energy consumption to drive the blade 131. The controller 500 outputs predetermined information mentioned later on a display 510 and changes a powder feeding speed of the powder feeder 300 or a rotational speed of the blade 132, based on the current value, i.e., the load to drive the blade 131.

Next, a hardware configuration of the controller 500 is explained referring to FIG. 13. In this embodiment, the controller 500 includes a control board, and a CPU 501, a ROM 502, a RAM 503 and non-volatile memory (NVRAM) 504 formed thereon. The CPU 501 controls all operations in the sieving system 1. The ROM 502 memorizes programs for operating the sieving system 1. The RAM 503 is used as a work area of the CPU 501. The NVRAM 504 holds data such as setup conditions of operations of the sieving apparatus 100 even while the controller 500 is shut down. A bus line 520 electrically connects the above configurations as shown in FIG. 12.

An I/O port 507 transmits and receives information to and from the blade-driving motor 141 and the encoder 143 of the sieving apparatus 100, and the powder feeder 300. The I/O port 507 provides an electric power to operate the blade-driving motor 141. The ammeter 508 is an embodiment of a measurer measuring a current value provided to the blade-driving motor 141. The display 510 includes a notifying means displaying predetermined information based on a status of the filter 122 to an operator of the sieving system 1 and a touch panel receiving an input the operator. In this embodiment, the I/O port 507, the ammeter 508 and the display 510 are located on the control board.

Next, the controller 500 is explained, referring to FIG. 14. The controller 500 includes a display controller 561, a feed controller 562 and a drive controller 563. These are activated by an order from the CPU 501 according a program memorized in the ROM 502 in FIG. 12.

The display controller 561 outputs a signal for displaying predetermined information based on a status of the filter on the display 510, based on a result of a current value measured by the ammeter 508. The feed controller 562 controls feeding of a powder from the powder feeder 300 to the sieving apparatus 100, based thereon. The drive controller 563 controls the blade-driving motor 141 to control rotation of the blade 131.

Powders used in the sieving system 1 are not particularly limited, and specific examples of the powder include synthetic resins or their combined powders such as toners, synthetic resin powder and particles, and powdery compounds; organic natural powders such as starches and wood powders; cereals or their powders such as rices, beans and flours; inorganic compound powders such as calcium carbonate, calcium silicate, zeolite, hydroxyapatite, ferrite, zinc sulfide and magnesium sulfide; metallic powders such as iron powders, copper powders and nickel alloy powders; inorganic pigments such as carbon black, titanium oxide and colcothar; and organic pigments dyes such as phthalocyaine blue and indigo. The sieving apparatus 100 of this embodiment is capable of efficiently sieving foreign particles such as powders, coarse particles and dusts with low stress, and is preferably used for sieving toners, cosmetic materials, medical materials, food materials, chemical materials, etc.

The toner is preferably selected from any one of the following mixtures (1) to (4):

(1) A mixture formed of at least a binder resin and a colorant;

(2) A mixture formed of at least a binder resin, a colorant and a charge controlling agent;

(3) A mixture formed of at least a binder resin, a colorant, a charge controlling agent and a wax; and (4) A mixture formed of at least a binder resin, a magnetic material, a charge controlling agent and a wax.

Specific examples of the binder resin include, but are not limited to thermoplastic resins such as vinyl resins, polyester resins and polyol resins. These can be used alone or in combination. Among these, the polyester resins and the polyol resins are preferably used.

Specific examples of the colorant include, but are not limited to black, white or colored pigments and dyes. These can be used alone or in combination.

Specific examples of the wax which gives releasability to a toner, include, but are not limited to synthetic waxes such as low-molecular-weight polyethylene and polypropylene; and natural waxes such as carnauba waxes, rice waxes and lanolin. A toner preferably includes a wax in an amount of from 1 to 20% by weight, and more preferably from 3 to 10% by weight.

Specific examples of the charge controlling agent include, but are not limited to nigrosin, acetylacetone metal complexes, monoazo metal complexes, naphthoic acids, fatty acid metal salts such as salicylate metal salts and metal salts of salicylic acid derivatives, triphenylmethane-based dyes, chelate molybdate pigments, rhodamine-based dyes, alkoxy-based amine, quaternary ammonium salts including fluorine-modified quaternary ammonium salts, alkylamide, phosphorus or its compounds, tungsten or its compounds, fluorine-containing activator. These can be used alone or in combination. A toner preferably includes a charge controlling agent in an amount of from 0.1 to 10% by weight, and more preferably from 0.5 to 5% by weight.

Specific examples of the magnetic material include, but are not limited to hematite, iron powder, magnetite, ferrite, etc. A toner preferably includes a magnetic material in an amount of from 5 to 50% by weight, and more preferably from 10 to 30% by weight.

Further, an inorganic fine powder such as a silica fine powder and a titanium oxide powder can externally be added to the toner.

The toner preferably has a number-average particle diameter of from 3.0 to 10.0 μm, and more preferably from 4.0 to 7.0 μm. In addition, the toner preferably has a ratio (weight-average particle diameter/number-average particle diameter) of a weight-average particle diameter to a number-average particle diameter of from 1.03 to 1.5, and more preferably from 1.06 to 1.2. The number-average particle diameter and the ratio (weight-average particle diameter/number-average particle diameter) of the toner can be measured by Coulter Counter Multisizer from Beckman Coulter®, Inc.

Next, operations and processes of the sieving system 1 are explained. First, operations and processes of the sieving system 1 when starting filling are explained. When the operation panel of the display 510 receives a request for starting filling, the drive controller 563 outputs a current for starting rotation of the blade 131 from the I/O port 507 to the blade-driving motor 141. The blade-driving motor 141 starts driving, based on the current to rotate the rotor 130. Thus, the shaft 132 rotates, and the blade 131 fixed at an end thereof rotates around the rotational axis Z close to the filter 122. In this case, the drive controller 563 controls the current value output to the blade-driving motor, based on a rotation output signal from the encoder 143 (feedback control) to rotate the blade 131 at a predetermined rotational speed, which is not particularly limited, but from 500 to 4,000 rpm. In this embodiment, the blade 131 is rotated before a powder is fed from the powder feeder 300 to the sieving apparatus 100 to stir coarse particles having remained on the filter 122 in the previous operation. Thus, the surface of the filter 122 is cleaned, and the sieving apparatus 100 efficiently perform sieving when the powder feeder 300 starts feeding a powder.

Next, the feed controller 562 transmits a signal for starting feeding a powder to the sieving apparatus 100 to the powder feeder 300. Thus, the powder feeder 300 starts feeding a powder to the sieving apparatus 100 (feed process). A powder fed from the powder feeder 300 passes the feed part 121*a* and is guided by the frame 121 to accumulate on the filter 122. Then, in a place where there is no influence of stirring of the blade 131, the powders P support each other (bridge) to accumulate on the filter 122.

Figure 16:
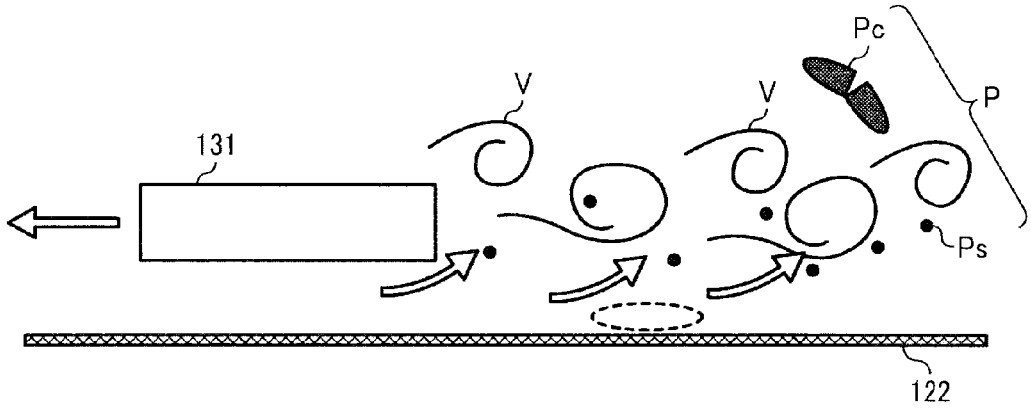
FIG. 16 is another schematic view illustrating a status of sieving a powder by the sieving apparatus in FIG. 2.

The blade 131 rotates in a powder accumulated on the filter 122 to stir and fluidize the powder (stirring process). Then, when the blade has a velocity in the powder P as a fluid, a vortex V generates behind a travel direction of the blade 131 (FIG. 16). A fluidized toner Pf which is mixed with air by the vortex V has low bulk density. Then, when the fluidized toner Pf falls under its own weight, a toner having a small particle diameter Ps efficiently passes the filter 122 with low stress.

Coarse particles Pc accumulated on the filter 122 contact blade 131 to be pulverized and are rolled up by the vortex V generated by rotation of the blade 131 (FIG. 16). Thus, the surface of the filter 122 is cleaned (cleaning effect) and the toner having a small particle diameter Ps becomes easier to pass the filter 122.

In this embodiment, a discharge part 121*b* discharging a powder out of the frame 121 is located on a side surface thereof. This regulates a powder accumulated on the filter 122 so as not to exceed a predetermined height to stabilize a pressure to the blade 131. Thus, an amount of energy required to drive the blade 131 does not vary so much, and preciseness of detections mentioned later improves.

Figure 17:
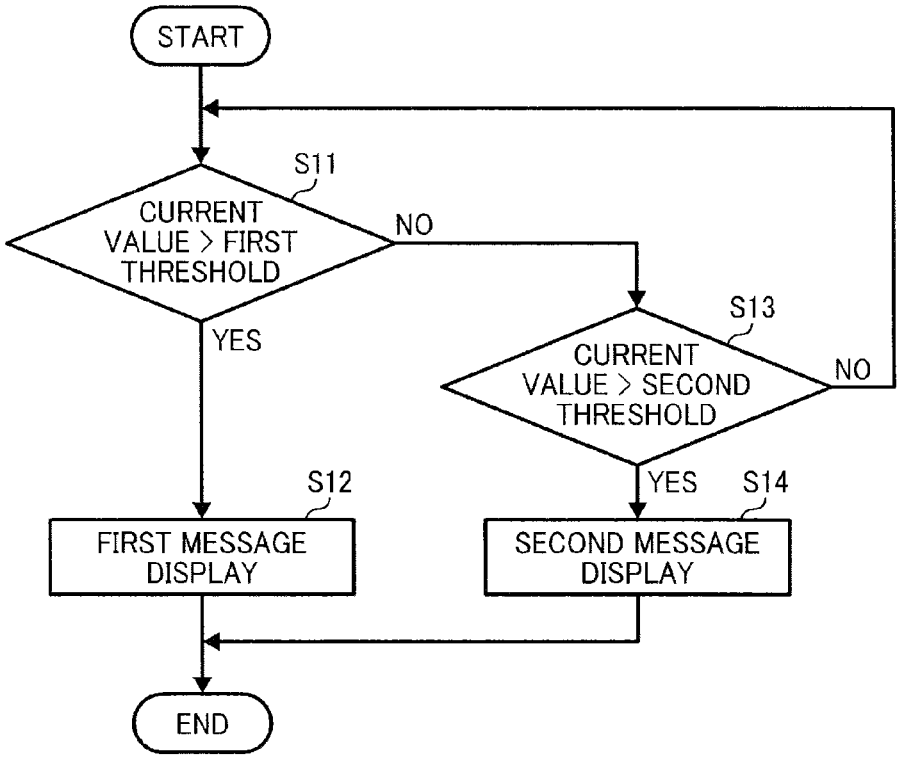
FIG. 17 is a process flowchart of the sieving system.
Figure 18:
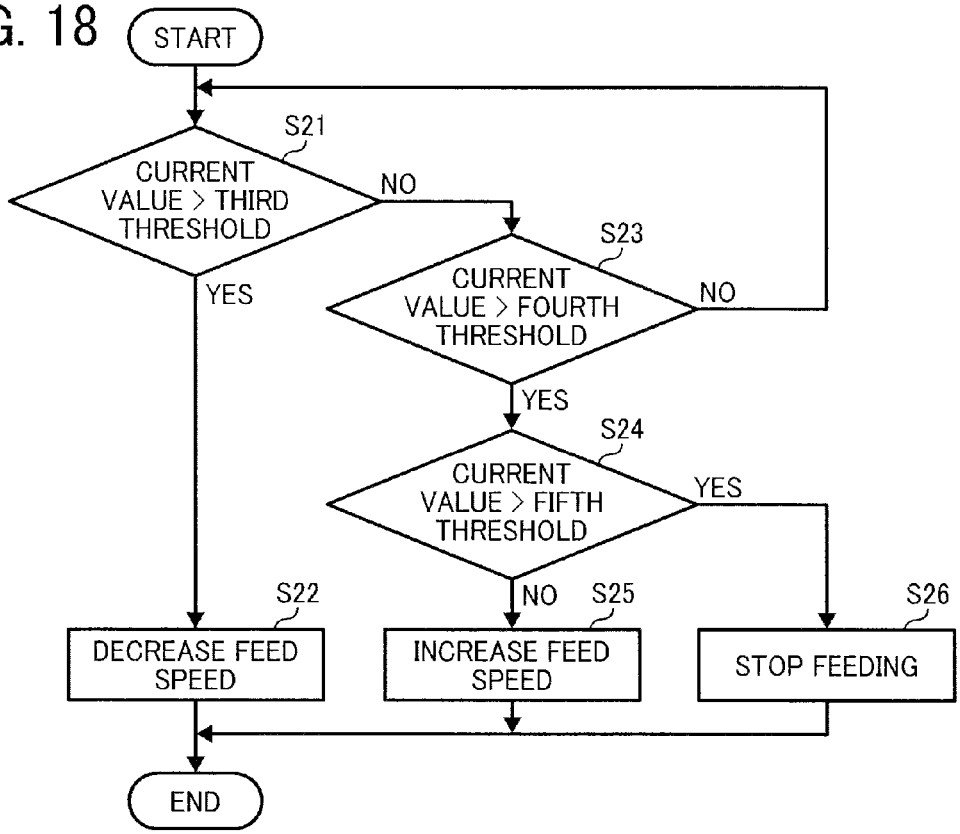
FIG. 18 is another process flowchart of the sieving system.
Figure 19:
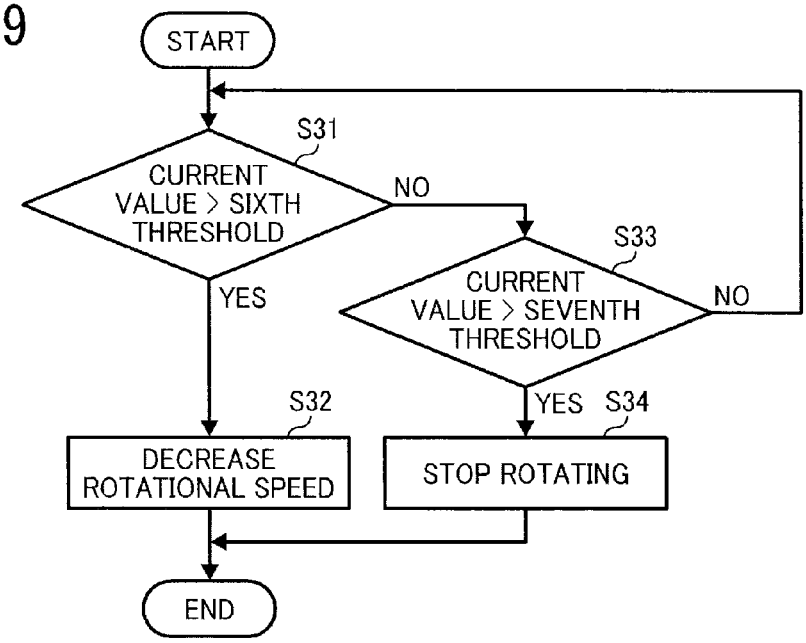
FIG. 19 is a further process flowchart of the sieving system.

Each process executed while the sieving apparatus 100 operates, based on a result measured by the ammeter 508 is explained, referring to FIGS. 17 to 19. FIGS. 17 to 19 are process flowcharts of the sieving system.

First, a process of outputting predetermined information of the status of the filter 122, based on a result measured by the ammeter 508 is explained, referring to FIG. 17. During operation of the sieving apparatus 100, the display controller 561 judges whether a current value measured by the ammeter 508 is larger than a first threshold or not (STEP S11). The first threshold is specified according to an actual current value, a rotational speed of the blade 131, durability of the blade-driving motor 141 and operation efficiency of the sieving apparatus 100 when operated while the filter 122 is clogged as an example of the status of the filter 122, and is preliminarily memorized in the NVRAM 204. Therefore, the first threshold is not particularly limited, but is specified, e.g., as Table 1 shows. In this embodiment, the status of the filter 122 is a status generated thereon while the sieving apparatus 100 operates, and varies the current value.

When a current value measured by the ammeter 508 is larger than the first threshold (YES in STEP S11), the display controller 561 makes the display 510 display predetermined information (a first message) based on a clogged status of the filter 122 (STEP S12). The first message is not particularly limited, but includes, e.g., information for notifying the filter 122 is clogged, information urging stopping operation of the sieving apparatus 100 and information that the current value is larger than the first threshold. Thus, an operator is able to understand the filter 122 of the sieving apparatus 100 is clogged and stop operation thereof.

When a current value measured by the ammeter 508 is not larger than the first threshold (NO in STEP S11), the display controller 561 judges whether it is smaller than a second threshold (STEP S13). The second threshold is specified according to an actual current value, a rotational speed of the blade 131, operation efficiency of the sieving apparatus 100 and an acceptable range of properties of a sieved product when the sieving apparatus 100 is operated while the openings of the filter 122 are opened due to a long period of use as an example of the status of the filter 122, and is preliminarily memorized in the NVRAM 204. Therefore, the second threshold is not particularly limited, provided it is smaller than the first threshold, but is specified, e.g., as Table 1 shows.

When a current value measured by the ammeter 508 is smaller than the second threshold (YES in STEP S13), the display controller 561 makes the display 510 display predetermined information (a second message) based on a opened status of the filter 122 (STEP S14). The second message is not particularly limited, but includes, e.g., information for notifying the filter 122 is opened, information urging exchanging the filter 122, information urging stopping operation of the sieving apparatus 100 and information that the current value is smaller than the second threshold. Thus, an operator is able to understand the filter 122 of the sieving apparatus 100 is opened and stop operation thereof.

Next, a process of controlling feeding a powder to the sieving apparatus 100, based on a result measured by the ammeter 508 is explained, referring to FIG. 18. During operation of the sieving apparatus 100, the feed controller 562 judges whether a current value measured by the ammeter 508 is larger than a third threshold or not (STEP S21). The third threshold is specified according to an actual current value, a rotational speed of the blade 131, durability of the blade-driving motor 141 and operation efficiency of the sieving apparatus 100 when operated while the filter 122 is clogged as an example of the status of the filter 122, and is preliminarily memorized in the NVRAM 204. Therefore, the third threshold is not particularly limited, but is specified, e.g., as Table 1 shows.

When the current value measured by the ammeter 508 is larger than the third threshold (YES in STEP S21), the feed controller 562 outputs a signal for decreasing feeding speed of a powder from the I/O port 507 to the powder feeder 300 as an example of predetermined information (STEP S22). Thus, an amount of the powder passing the filter decreases to prevent clogging from expanding. The feed controller 562 may output a signal for stopping feeding a powder instead of the signal decreasing feeding speed of a powder from the I/O port 507 to the powder feeder 300 as an example of predetermined information.

When a current value measured by the ammeter 508 is not larger than the third threshold (NO in STEP S21), the display controller 561 judges whether it is smaller than a fourth threshold (STEP S23). The fourth threshold is specified according to an actual current value, a rotational speed of the blade 131, operation efficiency of the sieving apparatus 100 when operated while a powder does not sufficiently accumulate on the filter 122 as an example of the status of the filter 122, and is preliminarily memorized in the NVRAM 204. Therefore, the fourth threshold is not particularly limited, provided it is smaller than the third threshold, but is specified, e.g., as Table 1 shows.

When a current value measured by the ammeter 508 is smaller than the fourth threshold (YES in STEP S23), the feed controller 562 judges whether it is smaller than a fifth threshold (STEP S24). The fifth threshold is specified according to an actual current value, a rotational speed of the blade 131, operation efficiency of the sieving apparatus 100 when operated while a powder does not at all accumulate on the filter 122 as an example of the status of the filter 122, and is preliminarily memorized in the NVRAM 204. Therefore, the fifth threshold is not particularly limited, provided it is smaller than the fourth threshold, but is specified, e.g., as Table 1 shows.

When a current value measured by the ammeter 508 is smaller than the fourth threshold and not smaller than the fifth threshold (NO in STEP S24), the feed controller 562 outputs a signal for increasing feeding speed of a powder from the I/O port 507 to the powder feeder 300 as an example of predetermined information (STEP S25). Thus, a powder is sufficiently fed to the sieving apparatus 100 to increase operation efficiency thereof.

When a current value measured by the ammeter 508 is smaller than the fourth threshold and the fifth threshold (YES in STEP S24), the feed controller 562 outputs a signal for stopping feeding a powder from the I/O port 507 to the powder feeder 300 as an example of predetermined information (STEP S26). Then, when a powder does not at all accumulate on the filter 122, operation of the sieving apparatus 100 is stopped to save energy. Therefore, a powder can automatically be discharged out from the sieving apparatus 100 (the apparatus automatically operates until becoming empty of a powder and stops).

A process of controlling driving the blade 131, based on a result measured by the ammeter 508 is explained, referring to FIG. 19. During operation of the sieving apparatus 100, the drive controller 563 judges whether a current value measured by the ammeter 508 is larger than a sixth threshold or not (STEP S31). The sixth threshold is specified according to an actual current value, a rotational speed of the blade 131, durability of the blade-driving motor 141 and operation efficiency of the sieving apparatus 100 when operated while the filter 122 is clogged as an example of the status of the filter 122, and is preliminarily memorized in the NVRAM 204. Therefore, the sixth threshold is not particularly limited, but is specified, e.g., as Table 1 shows.

When the current value measured by the ammeter 508 is larger than the sixth threshold (YES in STEP S31), the drive controller 563 outputs a signal for decreasing feeding speed of a powder from the I/O port 507 to the blade-driving motor 141 as an example of predetermined information (STEP S32). Thus, an amount of the powder passing the filter decreases to prevent clogging from expanding.

When a current value measured by the ammeter 508 is not larger than the sixth threshold (NO in STEP S31), the drive controller 563 judges whether it is smaller than a seventh threshold (STEP S33). The seventh threshold is specified according to an actual current value, a rotational speed of the blade 131, operation efficiency of the sieving apparatus 100 when operated while a powder does not at all accumulate on the filter 122 as an example of the status of the filter 122, and is preliminarily memorized in the NVRAM 204. Therefore, the seventh threshold is not particularly limited, provided it is smaller than the sixth threshold, but is specified, e.g., as Table 1 shows.

When a current value measured by the ammeter 508 is smaller than the seventh threshold (NO in STEP S33), the drive controller 563 outputs a signal for stopping rotation of the blade 131 from the I/O port 507 to blade-driving motor 141 as an example of predetermined information (STEP S34). Then, when a powder does not at all accumulate on the filter 122, operation of the sieving apparatus 100 is stopped to save energy.

Right after the sieving apparatus 100 starts operating, a current amount to drive the blade-driving motor 141 is not occasionally stabilized. Therefore, a part of or all of the processes of STEPS S11 to S14, STEPS S21 to S26 and STEPS S31 to S34 may be started after the current amount to drive the blade-driving motor 141 is stabilized.

TABLE 1

| | | |
|---|---|---|
| Drive conditions | Powder | Toner (average particle diameter 6.0 μm) |
| | Blade | Thickness 3.0 (mm) |
| | Filter opening | 50 μm |
| | Rotation number | 1500 rpm |
| First threshold | | 0.65 A |
| Second threshold | | 0.50 A |
| Third threshold | | 0.65 A |
| Fourth threshold | | 0.55 A |
| Fifth threshold | | 0.50 A |
| Sixth threshold | | 0.65 A |
| Seventh threshold | | 0.50 A |

In this embodiment, messages, etc. are output as an example of predetermined information, based on a result measured by the ammeter 508, but is not limited thereto. The predetermined information may be light such as alarm lamps and sounds such as warning sounds and voices.

In this embodiment, the controller 500 executes each control, based on a current value fed to the blade-driving motor 141. However, this embodiment is not limited thereto. The current value can be replaced with a voltage value or a torque value based on a load of the blade-driving motor 141 to drive the blade 131. The load to drive the blade 131 varies according to a pressure in the frame 121, and a pressure gauge may be located in the frame 121 to use a pressure measured thereby instead of the current value.

In this embodiment, a one-stage blade 131 is formed on the shaft 132, and multi-stage such as two-stage blade 131 may be formed at positions on the shaft 132, having different heights.

Figure 4:
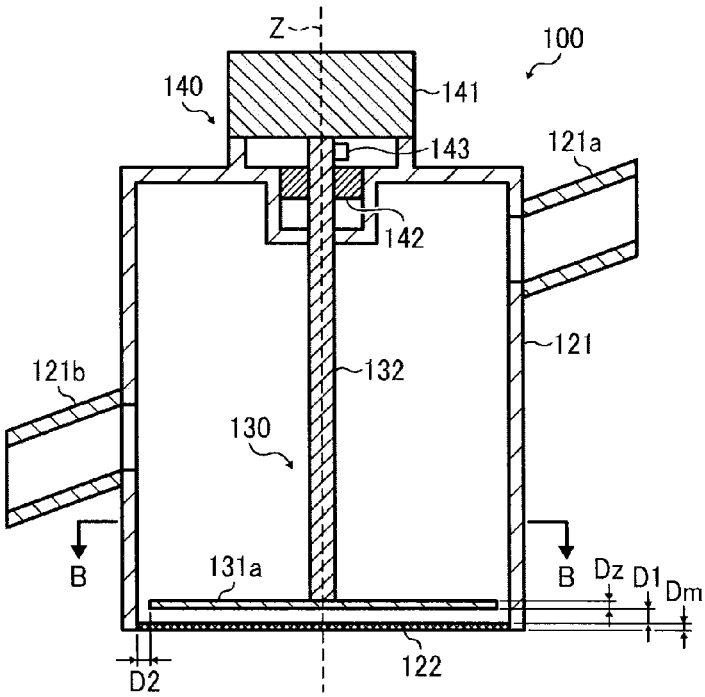
FIG. 4 is a cross-sectional view illustrating an A-A cross-section of the sieving system in FIG. 3.

In this embodiment, the filter 122 is formed on the whole surface of an end surface of a powder discharging side of the frame 121 as FIG. 4 shows, but the sieving apparatus of the present invention is not limited thereto. The filter 122 may be formed on a part of an end surface of a powder discharging side of the frame 121.

The sieving system 1 of this embodiment includes the filter 122, the blade 131 stirring a powder accumulated on the filter 122, the blade-driving motor 141 and the ammeter 508 measuring a current value to drive the blade. Then, clogging of the filter 122 is detectable, based on a result of simple measurement without a flowmeter, which prevents the apparatus from enlarging.

The blade-driving motor 141 rotates the blade 131 around the rotational axis Z intersecting with the filter 122. Then, the blade 131 rotates in nearly a parallel direction to the filter 122 a powder accumulates on to stabilize a load to drive the blade-driving motor 141.

A discharger part 121*b* discharging a powder out of the frame 121 as an embodiment of a regulator regulating a height of a powder accumulated on the filter 122 is located on a side surface of the frame 121. This prevents a powder from filling the frame 121 and breaking the filter 122 when clogged, and damaging the blade 131 and the blade-driving motor 141. In addition, the rotor 130 rotates while a powder accumulates at approximately a constant height, and a current value to drive the blade 131 is stabilized to increase preciseness of detection.

In the sieving apparatus 100 of this embodiment, a current value or a torque value is selected as a load, the controller 500 which is a power source can measure the load with ease.

The sieving system 1 of this embodiment includes the sieving apparatus 100 including the blade 131 rotatable close to the filter 122 around the rotational axis Z intersecting therewith. The blade 131 of the sieving apparatus 100 rotates to fluidize a powder P, and when a fluidized powder Pf falls under its own weight, a powder having a small particle diameter Ps efficiently passes the filter 122 with low stress. The sieving apparatus 100 is smaller than an ultrasonic sieving apparatus having similar sieving efficiency, and even when installed in the sieving system 1, it still has portability.

Figure 20:
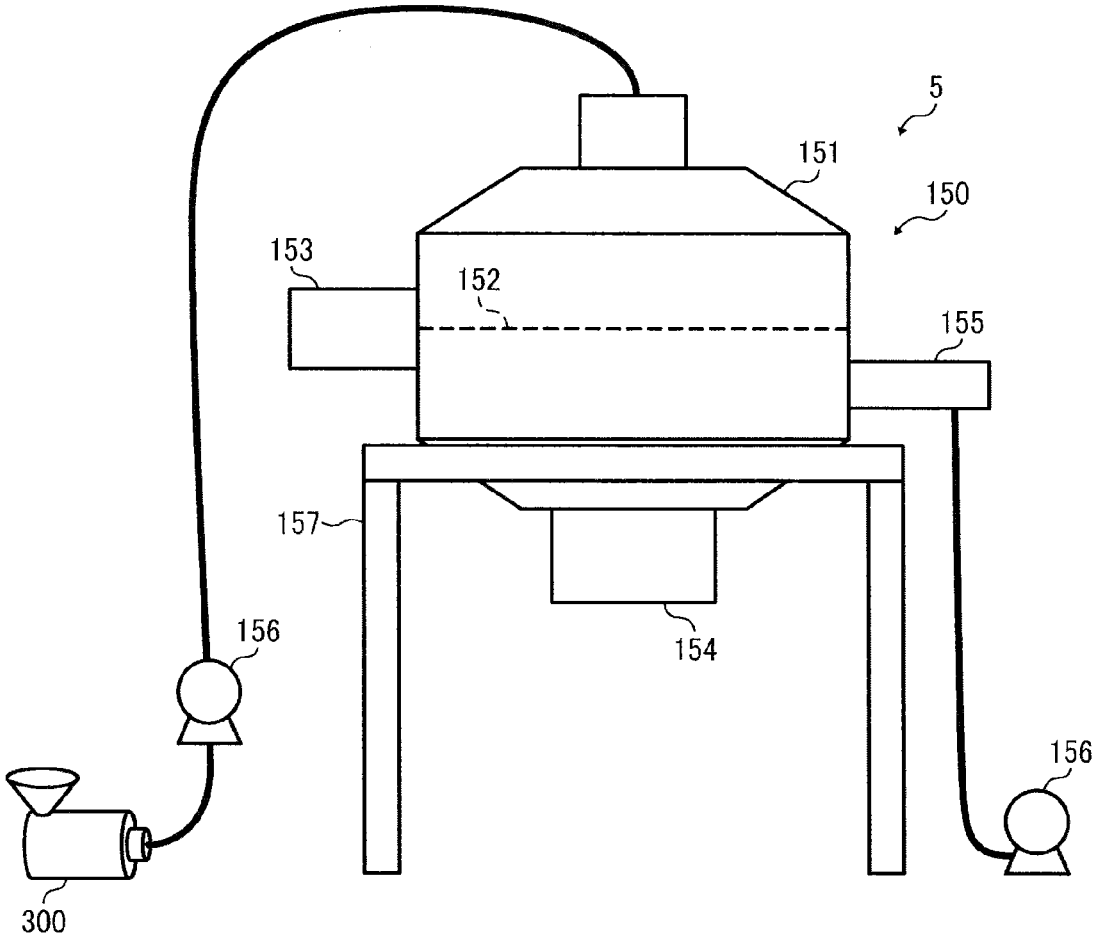
FIG. 20 is a schematic view illustrating a sieving system using an ultrasonic sieve.

A difference between the sieving system 1 of this embodiment and a conventional ultrasonic sieving system is explained, referring to FIG. 20. FIG. 20 is a schematic view illustrating a sieving system using an ultrasonic sieve. In an ultrasonic sieving apparatus 150 of a sieving system 5, an ultrasonic sieving apparatus main body 151 oscillates when a motor 154 is driven. When an ultrasonic oscillator 153 emits an ultrasonic wave to a filter 152, a powder having a small particle diameter out of a powder accumulated on the filter 152 passes the filter 152. However, the ultrasonic sieving apparatus 150 possibly impair quality of a powder with heat and stress due to oscillation. A platform 157 as shown in FIG. 20 is needed to set up the large ultrasonic sieving apparatus 150. A flowmeter 156 detecting clogging of the filter 152 further enlarges the apparatus.

In contrast, the sieving system 1 has the following effects, compared with the sieving system 5.

(i) The sieving apparatus 100 is small, and does not need a flowmeter 156 and much space. Even the sieving system 1 is portable.

(ii) When the blade 131 stops rotating, a vortex V generated in a rotation direction thereof immediately disappears (FIG. 19). Therefore, since feeding a powder to the powder feeder 300 can immediately be stopped after the blade 131 stops, a powder can precisely be fed.

(iii) Since aggregation of a powder due to frictional heat is prevented, even a powder having a low melting point can be sieved.

(iv) The blade 131 rotates to sieve and makes fewer noises due to oscillation.

(v) Since large oscillations are not made when sieving operation starts and stops, an oscillation-proofing structure is not needed at a connection between the sieving apparatus 100 and the powder feeder 300.

(vi) The sieving apparatus 100 is small, and does not need a high-place work and has good maintainability.

Having now fully described the invention, it will be apparent to one of ordinary skill in the art that many changes and modifications can be made thereto without departing from the spirit and scope of the invention as set forth therein.

What is claimed is:

1. A sieving system, comprising:

a filter;

a blade configured to stir a powder accumulated on the filter;

a driver configured to drive the blade; and a notifier configured to notify predetermined information of a status of the filter, based on a load of the driver, wherein the driver rotates the blade around a rotational axis intersecting with the filter.

2. The sieving system of claim 1, further comprising a regulator configured to regulate a height of the powder accumulated on the filter.

3. A method of notifying information, comprising:

notifying predetermined information of a status of the filter, based on a load of the driver to drive the blade in the sieving system according to claim 1.

4. The sieving system of claim 1, further comprising a frame that contains the powder, the frame including a feed part that feeds the powder into the frame and including a discharge part that discharges the powder from the frame.

5. The sieving system of claim 4, wherein the discharge part is on a side surface of the frame above the blade and below the feed part, in a height direction of the sieving system.

6. The sieving system of claim 4, wherein the filter is at a bottom portion of the frame, below the blade in the height direction of the sieving system.

7. The sieving system of claim 1, wherein the notifier includes an ammeter that measures the load of the driver and a display that displays the predetermined information of the status of the filter based on an output of the ammeter.

8. A sieving system, comprising:

a filter;

a blade configured to stir a powder accumulated on the filter;

a driver configured to drive the blade; and a drive controller configured to control the driver driving the blade, based on a load of the driver, wherein the driver rotates the blade around a rotational axis intersecting with the filter.

9. A method of controlling driving, comprising:

controlling driving the blade, based on a load of the driver to drive the blade in the sieving system according to claim 8.

10. A sieving system, comprising:

a filter;

a feeder configured to feed a powder on the filter;

a blade configured to stir the powder accumulated on the filter;

a driver configured to drive the blade; and a feed controller configured to control the feeder feeding powder on the filter, based on a load of the driver, wherein the driver rotates the blade around a rotational axis intersecting with the filter.

11. A method of controlling feeding, comprising:

controlling feeding the powder, based on a load of the driver to drive the blade in the sieving system according to claim 10.

* * * * *